US009799500B2

(12) United States Patent
Giuliani et al.

(10) Patent No.: US 9,799,500 B2
(45) Date of Patent: Oct. 24, 2017

(54) TANDEM MASS SPECTROMETER AND TANDEM MASS SPECTROMETRY METHOD

(71) Applicants: INSTITUT NATIONAL DE LA RECHERCHE AGRONOMIQUE-INRA, Paris (FR); SYNCHROTRON SOLEIL, St. Aubin (FR)

(72) Inventors: Alexandre Giuliani, Paris (FR); Matthieu Refregiers, Paris (FR); Aleksandar Milosavljevic, Belgrade (RS); Laurent Nahon, Paris (FR)

(73) Assignees: SYNCHROTRON SOLEIL, St. Aubin (FR); INSTITUT NATIONAL DE LA RECHERCHE AGRONOMIQUE, Paris (FR)

( * ) Notice: Subject to any disclaimer, the term of this patent is extended or adjusted under 35 U.S.C. 154(b) by 0 days.

(21) Appl. No.: 15/140,240

(22) Filed: Apr. 27, 2016

(65) Prior Publication Data

US 2016/0314952 A1 Oct. 27, 2016

Related U.S. Application Data

(63) Continuation of application No. 14/237,087, filed as application No. PCT/FR2012/051834 on Aug. 2, 2012, now abandoned.

(30) Foreign Application Priority Data

Aug. 5, 2011 (EP) ..... 11306019

(51) Int. Cl.
*H01J 49/00* (2006.01)
*H01J 49/42* (2006.01)

(52) U.S. Cl.
CPC ..... *H01J 49/0059* (2013.01); *H01J 49/0031* (2013.01); *H01J 49/0081* (2013.01); *H01J 49/4205* (2013.01)

(58) Field of Classification Search
CPC ..... H01J 49/0059; H01J 49/424; G01N 27/64
(Continued)

(56) References Cited

U.S. PATENT DOCUMENTS 4,296,330 A * 10/1981 Thomson ..... H01J 27/02 250/426
2007/0085040 A1* 4/2007 Reilly ..... H01J 49/0059 250/504 R (Continued)

*Primary Examiner* — Michael Maskell
(74) *Attorney, Agent, or Firm* — Young & Thompson

(57) ABSTRACT

The invention relates to a tandem mass spectrometer comprising an ionization source that can produce ions; a mass analyzer comprising an ion trap arranged in such a way as to receive ions from the ion source and a detector that can detect ions leaving the ion trap according to the mass to charge (m/z) ratio thereof; ion activation means for activating ions that can fragment at least some of the ions trapped in the ion trap; and coupling means arranged between the ion trap and said ion activation means. According to the invention, the ion activation means consists of a glow discharge lamp that can generate a light beam oriented towards the ion trap, said light beam being electromagnetic radiation in the vacuum ultraviolet wavelength range with photon energies of between 8 eV and 41 eV in such a way as to fragment at least some of the ions trapped in the ion trap.

13 Claims, 2 Drawing Sheets

(58) Field of Classification Search
USPC ..... 250/281–283
See application file for complete search history.

(56) References Cited

U.S. PATENT DOCUMENTS

| | | | | |
|---|---|---|---|---|
| 2007/0259110 | A1* | 11/2007 | Mahajani | C23C 16/45508 427/248.1 |
| 2009/0242753 | A1* | 10/2009 | Dogourd | G01N 27/64 250/283 |
| 2011/0168883 | A1* | 7/2011 | Furuhashi | H01J 49/0059 250/288 |
| 2011/0189788 | A1* | 8/2011 | Brown | H01J 49/0072 436/173 |

* cited by examiner

TANDEM MASS SPECTROMETER AND TANDEM MASS SPECTROMETRY METHOD

CROSS-REFERENCE TO RELATED APPLICATIONS

This application is a continuation of U.S. patent application Ser. No. 14/237,087, filed Feb. 4, 2014, which is the U.S. National Stage of International Application No. PCT/FR2012/051834, filed Aug. 2, 2012, which in turn claims the benefit of European patent application number 11306019.8, filed Aug. 5, 2011. Each of these applications is incorporated by reference in their entirety herein.

BACKGROUND

The present invention relates to a tandem mass spectrometry method and device.

Mass spectrometry (MS) is an analysis technique for detecting ions originating from a sample and for analyzing these ions based on their ratio (m/z), wherein m represents the mass of an ion and z represents its electric charge. Mass spectrometry is used in numerous applications for analyzing, identifying, and characterizing the chemical structure of ionized molecules.

A mass spectrometer generally includes an ionization source for forming the ions from a sample to be analyzed, an analyzer that separates the ions based on their m/z ratio, and a detector. A mass spectrum is produced by recording the ion abundance based on their mass-to-charge (m/z) ratio. However, simple mass spectrometry does not always make it possible to differentiate ions that have identical m/z ratios, particularly in complex molecules.

Tandem mass spectrometry is an ion analysis method that consists of selecting an ion via an initial mass spectrometry step, fragmenting it, then performing one or more other mass spectrometry step(s) on the ion fragments thereby generated, wherein the mass analysis steps can be spatially or temporally separated. Tandem mass spectrometry can be performed by isolating an ion inside an ion trap, then by supplying it with a sufficient quantity of internal energy for it to fragment: this step is referred to as activation. Detection of the products of this fragmentation can provide data on the structure of the parent ion. Tandem mass spectrometry is the foundation for mass spectrometry applications in structural analysis and in particular for sequencing proteins and other biopolymers (such as sugars or nucleic acids).

Various activation methods for fragmenting ions exist. Each activation method involves various activation means that can lead to various activation products.

The most widely-used ion activation method is referred to as CID, for "Collision-Induced Dissociation." Activation via CID consists of activating ions by inelastic collision between the ions and neutral target species, such as atoms or molecules of a rare gas (helium, nitrogen, argon, etc.). It consists of converting part of the ion's kinetic energy into internal energy. This method belongs to the class of vibrational activation methods, which are similar to slowly heating the ion. Despite its popularity, CID activation suffers from disadvantages. First, as a result of the collisions between ions and gas molecules, the trajectories of the ions can be modified. Hence, the CID step can lead to ion loss and decreased detector resolution. As a result of CID, competition occurs inside the ion trap between ion activation and ejection. Moreover, CID activation produces nonselective ion excitation: all of the ions present inside the ion trap can be excited by colliding with the gas. Finally, the efficacy of this method decreases as the mass-to-charge ratio of the ions increases. The mechanisms brought into play by CID are statistical and can cause the most fragile bonds to rupture. Therefore, CID does not make it possible to analyze certain ions with high m/z ratios or to obtain sequence data for certain molecules with fragile bonds.

A fragmentation technique using RF electromagnetic radiation is also known. US2005/009172A1 describes a tandem mass spectrometer for analyzing nonionized gas molecules that includes an ionization chamber, a VUV lamp for ionizing the gas molecules, an ion trap, an ion fragmentation unit inside the ion trap, and a time-of-flight mass analyzer for detecting the selected ions inside the ion trap. US2005/009172A1 states that the photon energy of the VUV lamp is sufficient for ionizing neutral molecules but insufficient for producing a fragmentation or dissociation beyond the ionization potential. According to this document, the ion fragmentation unit is composed of an electromagnetic radiation source, referred to as TICKLE, coupled to the ion trap.

Another method involving activation by laser is also known. EP1829082 describes the use, in tandem mass spectrometry, of a laser emitting in the visible range and near ultraviolet. The ions can absorb the energy of the laser beam photons. In principle, a selective activation can be generated based on the laser's emission wavelength. However, the available laser wavelengths are limited to the visible and to near ultraviolet and have limited photon energy at approximately 6.2 eV (or 200 nm).

SUMMARY

One of the goals of the invention is to provide a device and a method for analysis using mass spectrometry that is both selective and enables high resolution and detection efficacy, including for ions with a high m/z ratio.

Another goal of the invention is to provide a device and a method for analysis using tandem mass spectrometry that enables the production of fragmentation products that are different from or complementary to the prior art.

Yet another goal of the invention is to provide a device and method for analysis using tandem mass spectrometry that enables the production of fragmentation products analogous to those produced in the prior art, but at a lower operating cost.

The goal of the present invention is to eliminate the disadvantages of the prior art and more specifically relates to a tandem mass spectrometer, including an ionization source suitable for producing ions; a mass analyzer including an ion trap that is arranged so that it can receive ions originating from the ion source, and detection means suitable for detecting ions exiting the ion trap based on their mass m to charge z ratio (m/z); ion activation means suitable for activating at least part of the ions trapped inside the ion trap, and coupling means arranged between the ion trap and said ion activation means.

According to the invention, the ion activation means include a glow discharge lamp suitable for generating a light beam directed towards the ion trap, with said light beam being electromagnetic radiation within the vacuum ultraviolet (VUV) range at photon energies ranging from 8 eV to 41 eV, in order to fragment, photoionize, or result in the photodetachment of electrons of at least part of the ions trapped inside the ion trap.

Preferably, the ion activation means are composed of said glow discharge lamp suitable for generating a light beam directed towards the ion trap.

According to various specific features of the invention:

- the device additionally includes control means for turning on the glow discharge lamp so as to control the start and duration of activation via VUV radiation;
- said coupling means include a beam shutter for controlling the start and duration of activation via VUV radiation;
- said coupling means include an optical system with a mirror and/or with a lens that is arranged so as to optimize the interaction of the VUV radiation beam with an ion packet stored inside the ion trap;
- said coupling means include vacuum mechanical connecting means and differential pumping means suitable for pumping the glow discharge lamp so as to enable simultaneous operation of the glow discharge lamp and the mass spectrometer;
- the ionization source includes an electrospray source, an electronic impact source, a chemical ionization source, a photoionization source, a matrix-assisted laser-induced desorption (MALDI) source, an atmospheric-pressure MALDI source, an atmospheric-pressure chemical ionization source, or an atmospheric-pressure photoionization source;
- the glow discharge lamp is a discharge lamp in a gas of helium, neon, argon, krypton, or a mixture of a plurality of these gases;
- the ion trap includes a radiofrequency ion trap, a 3D radiofrequency ion trap, or a quadrupole linear ion trap;
- the detection means include an ion detector or another mass analyzer equipped with an ion detector, or a time-of-flight mass analyzer.

The present invention additionally relates to a tandem mass spectrometry method including the following steps:

- generating ions by means of an ion source;
- trapping at least part of the ions originating from the ion source;
- selecting and activating the trapped ions so as to activate at least part of the ions trapped inside the ion trap;
- analyzing and detecting ions exiting the ion trap based on their mass m to charge z (m/z) ratio);

According to the method of the invention, the ion selection and activation step includes a step for photoactivation of the trapped ions by a light beam originating from a glow discharge lamp, with said light beam being electromagnetic radiation in the vacuum ultraviolet wavelength range at photon energies ranging from 8 eV to 41 eV, in order to fragment, photoionize, or result in the photodetachment of electrons of at least part of the ions trapped inside the ion trap.

Preferably, the ion selection and activation step consists of said step for photoactivation of the trapped ions by a light beam originating from a glow discharge lamp.

According to various specific features of the method of the invention:

- the wavelength of the light beam emitted by the glow discharge lamp is adjusted so as to produce various ion fragmentation products;
- activation of the ions is applied for a predetermined duration;
- the method includes one or several selection and activation steps prior to ion analysis and detection.

The invention will find an especially advantageous application in tandem mass spectrometry.

The present invention also relates to the characteristics that will emerge over the course of the following description, and that should be considered in isolation or according to all technically-possible combinations thereof.

This description, provided by way of non-limiting example, will allow the reader to more fully understand how the invention is embodied with reference to the attached drawings.

DETAILED DESCRIPTION

We are proposing a novel device for analysis using mass spectrometry that implements, on the one hand, an ion-trap-type mass spectrometer and an ultraviolet beam produced by a discharge lamp ensuring the photoactivation (by fragmentation, photoionization, and/or photodetachment) of the accumulated ionized molecules inside the mass spectrometer.

We are proposing a coupling between a discharge lamp and an ion trap. An opening is made in the mass spectrometer so as to enable irradiation of the ions inside the trap. This opening makes it necessary to resolve issues relating to preserving a vacuum level that is compatible with the operation of the ion trap and/or of the mass spectrometer. If the lamp is not sealed and has no window, differential pumping must be installed between the lamp and the ion trap or the mass spectrometer so that the pressure difference between these two parts can be reconciled. If the radiation emitted by the lamp can be transmitted through a vacuum-sealed window system, e.g., a window made of molten silica, $MgF_2$, $CaF_2$, $LiF_2$, etc., an adequate and vacuum-sealed window can be placed onto the opening made in the mass spectrometer or in the ion trap, so as to maintain the required vacuum level in the mass spectrometer or in the ion trap. The space between the lamp and the window giving access to the ions is made transparent to the radiation given off by the lamp. This can be done by evacuating this space or by filling it with a radiation-transparent gas because vacuum ultraviolet (VUV) is totally absorbed by atmospheric gases. The lamp can also be installed directly in lieu of the spectrometer access window. Optionally, one or several optical components (e.g., one or several mirrors or one or several lenses) can be installed between the lamp and the ion trap in order to improve ion irradiation. Preferably, the device includes a system for controlling the start and duration of irradiation. This irradiation control system can be an electromechanical beam shutter, for example, or any other system for physically sealing off the radiation. This irradiation control system can also be a means for controlling intermittently whether the lamp is switched on or off.

We are proposing a novel activation method based on the excitation of ions using vacuum ultraviolet radiation emitted by a glow discharge lamp.

Figure 1:
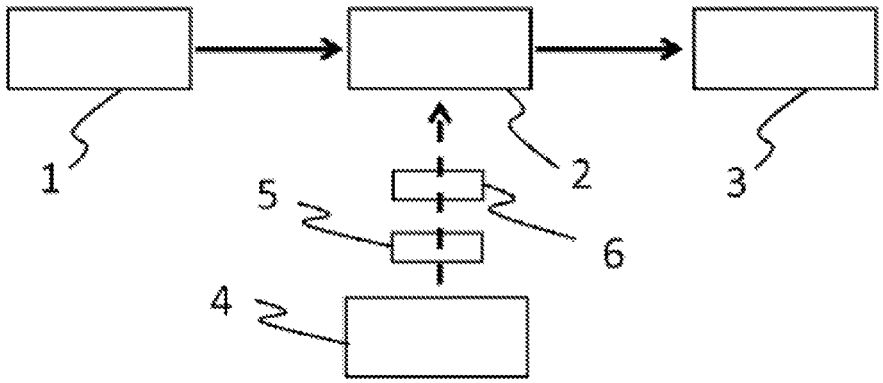
FIG. 1 shows a diagram of a tandem mass spectrometry device of the invention.

FIG. 1 shows a diagram of the invention. FIG. 1 is not drawn to scale and is provided in order to illustrate the description of the invention. The system of the invention includes an ion source 1, an ion trap 2, a detection system 3, a VUV (vacuum ultraviolet) discharge lamp 4, a beam shutter system 5, and vacuum mechanical and technical optical coupling means 6. The solid-line arrows show, in diagram form, the ion flux and the dashed-line arrow shows the UV light beam.

The ion source 1 generates ions through physical and/or chemical interaction with a sample to be analyzed. According to the case at hand, the sample to be analyzed can be in solid, liquid, or gas form. The ion source 1 can be of various types: electron impact (EI) source, chemical ionization (CI) source, photoionization (PI) source, matrix-assisted laser-induced desorption (MALDI) source, atmospheric-pressure MALDI (AP-MALDI) source, atmospheric-pressure chemical ionization (APCI) source, atmospheric-pressure photoionization (APPI) source, or electrospray (ESI). Therefore, the ion source generates ions that are to be analyzed using the mass analyzer. The ions produced by the ion source are transmitted into an ion trap 2. An ion trap is a specific apparatus that enables storage of ions inside the space in the form of an ion cloud. An ion trap generally includes an intake for ion injection, an area where trapping occurs, and an outlet for ejection of ions towards a detector or a tandem mass analyzer equipped with its detection system. The ion trap 2 can be of the radiofrequency type, such as a 3D trap, a quadrupole linear trap, or another type. In the example, the ion trap 2 enables analysis of the ions produced by the ion source according to their mass-to-charge (m/z) ratio, in a mass spectrometry (MS)-type operation. The ion trap 2 makes it possible to select and isolate an m/z ratio range in order to perform a tandem mass spectrometry experiment. The trapped ions are then activated by interacting with a VUV radiation beam originating from a discharge lamp 4.

The discharge lamp 4 emits VUV (for Vacuum Ultra Violet)-type electromagnetic radiation; that is, in a wavelength range extending from approximately 30 nm to less than 180 nm. This lamp can be of the UVS40A2 type marketed by Henniker Scientific, the VUV500 type marketed by Scienta, or the PID type (PXS084, PXR 084, etc.) marketed by Heraeus Noblelight. Let's briefly summarize how a discharge lamp operates: an electric discharge or a microwave discharge excites a gas that emits fluorescent radiation. The gas, which may be helium, neon, argon, krypton, or any other gas, emits electromagnetic radiation in the VUV, and more specifically in an energy range ranging from 8 to 41 eV; that is, for wavelengths ranging from approximately 30 to 155 nm.

The activation step is ensured by illuminating the ions inside the ion trap using the light beam from the VUV lamp. The lamp can be sealed and closed by a radiation-transparent window. The lamp may also issue an overly-energetic radiation that is absorbed by the materials of vacuum-sealed traditional windows. In this case, it is advisable to avoid placing an absorbent window along the optical path between the lamp and the ion trap, while providing different vacuum operating conditions for the ion trap and the lamp, respectively. One solution consists of applying differential pumping of the lamp in order to maintain pressure conditions that are compatible with the startup and maintenance of the glow discharge needed for VUV radiation production and pressure conditions that are compatible with the operation of the mass spectrometer or of the ion trap. If the lamp's radiation wavelength allows, a vacuum-sealed optical window is mounted onto the mass spectrometer or the ion trap. The intermediary space between the lamp and the window that gives access to the ions is made transparent to the VUV radiation given off by the lamp. This can be accomplished by evacuating this intermediary space or by filling it with a radiation-transparent gas, since vacuum ultraviolet (VUV) is totally absorbed by atmospheric gases. The lamp can also be mounted directly in lieu of the spectrometer access window. Optional optical parts (e.g., one or several mirrors or one or several lenses) can be installed between the lamp and the ion trap in order to improve ion irradiation, if necessary.

The ions trapped inside the ion trap receive VUV radiation that activates them by photoactivation.

The ion selection, isolation, and activation steps are performed inside the ion trap and can be repeated if the trap allows it in a level n of tandem mass spectrometry $MS^n$. Hence, following a first tandem mass spectrometry step, an m/z ratio range can be selected again and trigger another activation—fragmentation procedure. This procedure can be repeated n times prior to ion detection.

Figure 2:
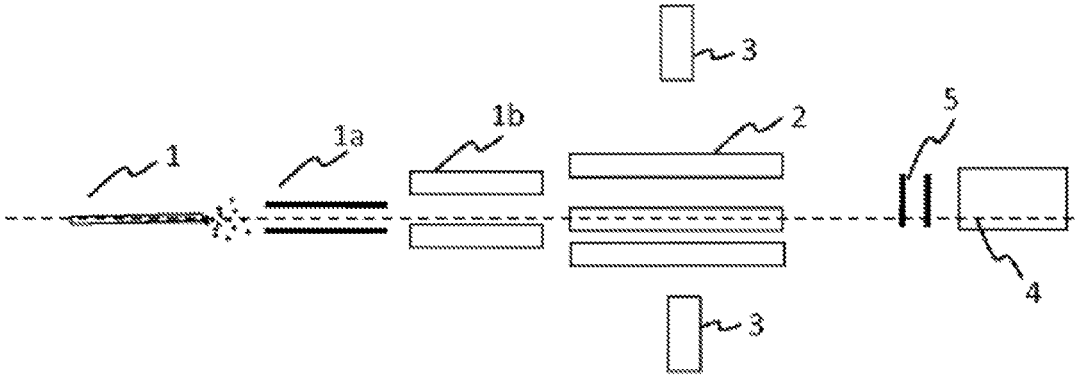
FIG. 2 shows a diagram of a tandem mass spectrometry device according to a first embodiment of the invention.

The detector 3 is a traditional mass spectrometer detector and enables detection of ions exiting the ion trap 2. In lieu of the detector 3, another type of analyzer, along with its detection system, can be installed, e.g., a time-of-flight analyzer equipped with its own ion detection system. FIG. 2 shows a diagram of an MS-MS mass spectrometry device according to an embodiment of the present invention. In this example, the ions are formed by an electrospray source 1 and transferred by a capillary 1*a* into an ionic optical system 1*b*. The ionic optical system 1*b* leads the ions into the ion trap 2, which is, in this example, a quadrupole linear-type ion trap. The VUV lamp 4 is a gas discharge lamp. A microwave or electric discharge in a gas causes the emission of VUV radiation. The wavelength of this emission depends upon the nature of the gas. One may use, e.g., helium, neon, argon, or krypton, or any other gas. The VUV radiation is absorbed by the ions and can lead to photodissociation, photodetachment, and/or photoionization. In a tandem mass spectrometry experiment, ions of interest are selected and subjected to radiation over a time period that can be controlled by a beam shutter 5. The VUV radiation enters the ion trap through an opening. This opening can be sealed by a radiation-transparent optical window. This opening can be in direct contact with the lamp via a differential pumping system 6 that maintains an adequate vacuum for the operation of the lamp, the mass spectrometer, and the ion trap. When irradiation is terminated, the contents of the ion trap are analyzed by the detection system 3.

Figure 3:
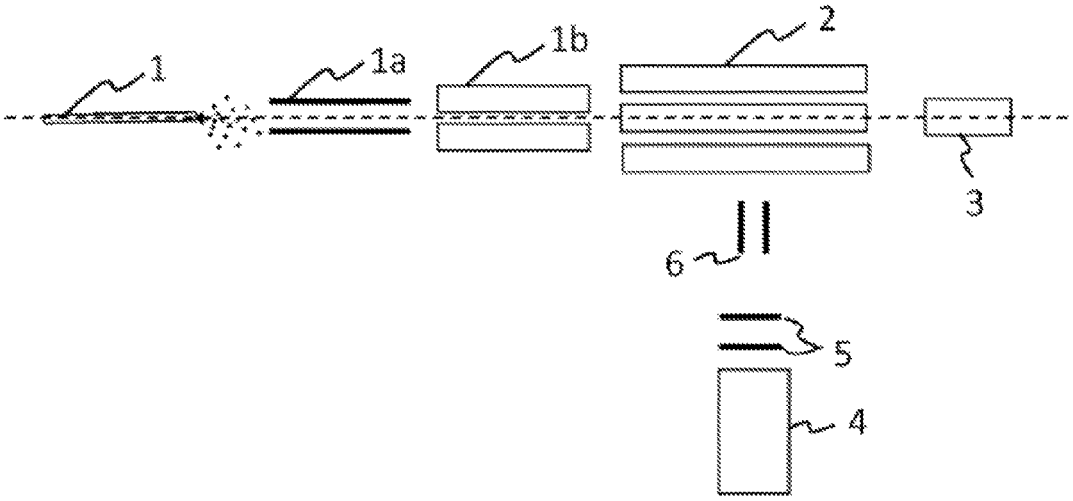
FIG. 3 shows a diagram of a tandem mass spectrometry device according to a second embodiment of the invention.

FIG. 3 shows a diagram of an example of a device according to a second embodiment of the present invention, wherein another geometry for mounting the VUV lamp is used. The geometry for mounting the lamp is not restrictive. It must enable irradiation of the ions. Various types of reactions can be induced by absorption of VUV light. Here are a few examples of these reactions:

$$[M+nH]^{n+}+h\nu \rightarrow \text{Fragment ions} \quad (a)$$

$$[M+nH]^{n+}+h\nu \rightarrow [M+nH]^{n+1}+e^{-}+\text{Fragment ions} \quad (b)$$

$$[M+nH]^{n+}+h\nu \rightarrow [M+nH]^{n+m}+m\times e^{-}+\text{Fragment ions} \quad (c)$$

$$[M-nH]^{n-}+h\nu \rightarrow \text{Fragment ions} \quad (d)$$

$$[M-nH]^{n-}+h\nu \rightarrow [M-nH]^{n-1}+e^{-}+\text{Fragment ions} \quad (e)$$

$$[M-nH]^{n-}+h\nu \rightarrow [M-nH]^{n-m}+m\times e^{-}+\text{Fragment ions} \quad (f)$$

In the case of a positive ion, absorption of VUV light can lead to photodissociation (path a) producing informative fragment ions on the sequence of a polypeptide ion, for example, or of another biopolymer or ionized molecule. If the photon energy is sufficient, it is possible to photoionize the ions in order to produce photoions whose charge can be increased one time (path b) or m times (path c). Fragment ions can be formed.

In the case of a negative ion, absorption of VUV light can lead to photodissociation of ions, to form informative ion fragments on the sequence of a polypeptide ion or of another biopolymer or ionized molecule (path d). If the photon energy is sufficient, electrons can be photodetached (paths e and f) and lead to fragment ions.

Photoactivation via radiation from a VUV lamp can lead to fragmentations that are similar to those obtained by techniques of the prior art. However, photoactivation via radiation from a VUV lamp can also make it possible to produce fragmentations that are not accessible by laser activation.

Discharge lamps have properties that are very different from lasers in terms of power, wavelength ranges, and wavelength tunability. Indeed, a VUV discharge lamp generates a beam whose photons are more energetic than a laser beam and therefore makes it possible to access the far ultraviolet and the vacuum ultraviolet (VUV).

Coupling a mass spectrometer and a VUV lamp has never been reported. In comparison with methods using UV lasers, VUV discharge lamps are inexpensive. Discharge lamps are easy to use. These lamps do not involve any specific risks, as lasers do. Nevertheless, the principle of these lamps is to use the fluorescent radiation emitted by a gas after it has been excited (by an electric discharge, microwave discharge). Therefore, it may be necessary to supply the lamp with a gas source, e.g., a gas cylinder, if the lamp is not sealed. Discharge lamps are versatile: the wavelength of the emitted radiation is tunable according to the type of gas used. One may therefore select a wavelength that is well-suited to the process that one wishes to promote.

The activation method of the invention offers various advantages with comparison to prior techniques. Compared to CID there is no competition between excitation and ejection, because the ion trajectories are not disturbed by interaction with the VUV light.

The method of the invention is based on ion activation following interaction with a VUV photon beam, which can be highly selective depending upon the wavelength of the incident light. The effective photoabsorption cross section increases along with the size of the ion species (their number of electrons) and therefore along with the molecular weight of the irradiated species. The device and method of the invention thereby enable analysis by mass spectrometry that is both selective and highly effective, including for high-molecular-weight ions.

Advantageously, the fragmentations generated by the method of the invention can be different from and complementary to other fragmentation methods and, in particular, to CID. Hence, the fragmentations generated by CID are mainly of the b- and y-types for polypeptides, whereas photodissociation produces varied types of ions; in particular, the formation of a- and x-ions has been reported.

The invention claimed is:

1. A tandem mass spectrometer, including:

an ionization source suitable for producing ions;

a mass analyzer including an ion trap that is arranged so that the ion trap can receive ions originating from the ion source, and detection means suitable for detecting ions exiting the ion trap based on their mass m to charge z ratio (m/z);

ion activation means suitable for activating at least part of the ions trapped inside the ion trap; and coupling means (5, 6) arranged between the ion trap and said ion activation means, wherein the ion activation means are composed of a glow discharge lamp suitable for generating a light beam directed towards the ion trap, said light beam being an electromagnetic radiation within the vacuum ultraviolet (VUV) range at photon energies ranging from 8 eV to 41 eV, in order to fragment at least part of the ions trapped inside the ion trap, wherein the wavelength of the light beam emitted by the glow discharge lamp is adjustable so as to produce various ion fragmentation products, and wherein said coupling means include vacuum mechanical connecting means and differential pumping means suitable for pumping the glow discharge lamp so as to enable simultaneous operation of the glow discharge lamp and the tandem mass spectrometer.

2. The mass spectrometer of claim 1, additionally including control means for turning on the glow discharge lamp so as to control the start and duration of activation via VUV radiation.

3. The mass spectrometer of claim 1, wherein said coupling means include a beam shutter for controlling the start and duration of activation via VUV radiation.

4. The mass spectrometer of claim 1, wherein said coupling means include an optical system with a mirror and/or with a lens that is arranged so as to optimize the interaction of the VUV radiation beam with an ion packet stored inside the ion trap.

5. The mass spectrometer of claim 1, wherein the ionization source includes an electrospray source, an electronic impact source, a chemical ionization source, a photoionization source, a matrix-assisted laser-induced desorption (MALDI) source, an atmospheric-pressure MALDI source, an atmospheric-pressure chemical ionization source, or an atmospheric-pressure photoionization source.

6. The mass spectrometer of claim 1, wherein the glow discharge lamp is a discharge lamp in a gas of helium, neon, argon, krypton, or a mixture of a plurality of these gases.

7. The mass spectrometer of claim 1, wherein the ion trap includes a radiofrequency ion trap, a 3D radiofrequency ion trap, or a quadrupole linear ion trap.

8. The mass spectrometer of claim 1, wherein the detection means include an ion detector or another mass analyzer equipped with an ion detector.

9. A tandem mass spectrometry method, including the following steps:

generating ions by means of an ion source;

trapping at least part of the ions originating from the ion source in an ion trap;

selecting and activating the trapped ions so as to activate at least part of the ions trapped inside the ion trap; and analyzing and detecting ions exiting the ion trap based on their mass m to charge z (m/z) ratio, wherein the ion selection and activation step includes i) a step of coupling a glow discharge lamp to the ion trap by vacuum mechanical connecting means and differential pumping means suitable for pumping the glow discharge lamp so as to enable simultaneous operation of the glow discharge lamp and ii) a step for photoactivation of the trapped ions by a light beam originating from the glow discharge lamp, with said light beam being an electromagnetic radiation within the vacuum ultraviolet range at photon energies ranging from 8 eV to 41 eV in order to fragment at least part of the ions trapped inside the ion trap, and wherein the ion activation step at photon energies ranging from 8 eV to 41 eV is repeated n times prior to ion detection and the wavelength of the light beam emitted by the glow discharge lamp is adjusted so as to produce various ion fragmentation products.

10. The tandem mass spectrometry method of claim 9, wherein activation of the ions is applied for a predetermined duration.

11. The tandem mass spectrometry method of claim 9 additionally including one or plural selection steps prior to ion analysis and detection.

12. The tandem mass spectrometry method of claim 9, wherein the ion fragments formed are different from those formed by Collision-Induced Dissociation (CID).

13. The tandem mass spectrometry method of claim 9, wherein the ion fragments formed are different from those formed by laser dissociation.

* * * * *